US010995586B2

(12) United States Patent
Gonzales Panta et al.

(10) Patent No.: US 10,995,586 B2
(45) Date of Patent: May 4, 2021

(54) FULLY ELECTRIC TOOL FOR CONTINOUS DOWNHOLE FLOW CONTROL

(71) Applicant: OURO NEGRO TECNOLOGIAS EM EQUIPAMENTOS INDUSTRIAIS S/A, Rio de Janeiro (BR)

(72) Inventors: Pedro Eduardo Gonzales Panta, Niteroi (BR); Auderi Vicente Santos, Barra da Tijuca (BR); Leonardo Gonçalves Candido Gomes, Maracanã (BR)

(73) Assignee: OURO NEGRO TECNOLOGIAS EM EQUIPAMENTOS INDUSTRIAIS S/A, Rio de Janeiro (BR)

( * ) Notice: Subject to any disclaimer, the term of this patent is extended or adjusted under 35 U.S.C. 154(b) by 38 days.

(21) Appl. No.: 16/320,812

(22) PCT Filed: Dec. 13, 2017

(86) PCT No.: PCT/BR2017/050381
§ 371 (c)(1),
(2) Date: Apr. 11, 2019

(87) PCT Pub. No.: WO2018/107260
PCT Pub. Date: Jun. 21, 2018

(65) Prior Publication Data

US 2019/0292879 A1 Sep. 26, 2019

(30) Foreign Application Priority Data

Dec. 14, 2016 (BR) ..... BR102016029404-5

(51) Int. Cl.
*E21B 34/06* (2006.01)
*E21B 43/12* (2006.01)

(52) U.S. Cl.
CPC ..... *E21B 34/066* (2013.01); *E21B 34/06* (2013.01); *E21B 43/12* (2013.01); *E21B 2200/04* (2020.05)

(58) Field of Classification Search
CPC ..... E21B 34/06; E21B 34/066; E21B 17/206; E21B 43/12; E21B 2200/14
See application file for complete search history.

(56) References Cited

U.S. PATENT DOCUMENTS 5,832,996 A 11/1998 Carmody et al.
6,253,843 B1 7/2001 Rawson et al.
(Continued)

*Primary Examiner* — D. Andrews
(74) *Attorney, Agent, or Firm* — Malin Haley DiMaggio & Bowen, P.A.

(57) ABSTRACT

A fully electric tool for continuous downhole flow control is described, said tool comprising a body and along the said body, actuating set(s), each actuating set comprising a passage system comprised of shaft(s) radially disposed along said cylindrical body, each of said shaft (s) being actuated with its opposed pair or in an independent way in a well-defined position or not, said shaft(s) being provided of spherical element(s) or sphere(s), provided of at least one window forming piles of sphere(s) in shaft(s), the rotation of said shaft(s)(108) of piles of sphere(s) enabling the opening or total or partial obstruction of holes by the total or partial coincidence of said window(s) of sphere(s) with said bore(s) of said cylindrical body.

26 Claims, 13 Drawing Sheets

(56) References Cited

U.S. PATENT DOCUMENTS

| | | | | |
|---|---|---|---|---|
| 2003/0168223 | A1* | 9/2003 | Bergren | E21B 34/06 166/386 |
| 2014/0160891 | A1 | 6/2014 | Russell | |
| 2014/0224342 | A1 | 8/2014 | Bao et al. | |
| 2017/0342804 | A1* | 11/2017 | Poluchalla | E21B 34/101 |
| 2018/0058176 | A1* | 3/2018 | Froehling | F16K 11/0876 |
| 2018/0119516 | A1* | 5/2018 | Moura | E21B 17/18 |

* cited by examiner

FULLY ELECTRIC TOOL FOR CONTINOUS DOWNHOLE FLOW CONTROL

CROSS REFERENCE TO RELATED APPLICATIONS

This application claims priority to PCT Application No. PCT/BR2017/050381, filed on Dec. 13, 2017, which claims priority to Brazilian Patent Application No. BR102016029404-5 filed on Dec. 14, 2016.

FIELD OF THE INVENTION

The present invention relates to a fully electric tool of the valve type for the continuous control of downhole opening and closure of offshore or onshore wells, the wells being injection or producing wells. The tool is designed for flow control.

BACKGROUND INFORMATION

In spite of the continuous search for alternative sources of energy, there is still great interest in the extraction of oil and gas aiming at supplying the growing worldwide demand. Due to the instability of the oil price linked to crisis times, the optimization of the process from extraction to distribution aiming at lower costs is mandatory.

One of the main aspects connected to the oil and gas extraction is the well completion system. As a result of restrictions within the wells, the tools utilized in completion are provided with a complex functionality which challenges the technological companies of the oil and gas field. Among these tools is the valve utilized both for injection and production in the downhole. The double position valve (ON/OFF) dominates the industry by its toughness and ease of operation. There is, however, interest on the industry side on valves which allow more than one position (multi-positions) or which can achieve continuous flow control.

Continuous downhole flow control is advisable in the technique of oil and gas wells extraction, since in this way it is possible a better and more efficient well management. This is because it enables the flow control of produced or injected fluid into the selected well zones, reducing the extraction of undesirable fluids such as water and gas. The proposed procedure therefore improves the recoverable oil volume (the recovery factor).

As relates to the operation of the downhole flow control valves utilized in Brazil and worldwide, it is usual to employ hydraulic operation (FIG. 1) which, in spite of not showing a continuous opening control, is highly dependable, being ideal for twin positions systems (ON/OFF).

Replacement of the hydraulic mode of operation of downhole valves by an exclusively electric mode provides a few advantages. Among these advantages is the lack of requirement of hydraulic power units and of the infrastructure required for the transmission of hydraulic power which is generally less efficient and consequently entrain high energy consumption and occupy a space which is generally restricted. A further advantage is the valves' positioning control which is more precise than for the systems operating hydraulically.

A fully electric operating valve for downhole flow control requires a somehow higher investment as compared to the investment for a conventional valve. However, by enabling a selective, independent management of each well zone, the well recovery factor is improved, this entailing a higher financial return as compared with the amount invested in the tool.

In the present oil and gas market, in spite of the existence of a few fully electric completion systems, these are not yet consolidated in the industry and due to their restricted reliability, they are utilized at a very small scale as compared with the hydraulic or electro-hydraulic systems The electric control of production flow is generally obtained by means of solenoids which are positioned at the wellhead (as can be seen in U.S. Pat. No. 5,832,996), which reduces the number of supply lines between the power supplying unit and the wellhead (FIG. 2) or by means of a motor/spindle set which drives a hydraulic piston so as to operate the sliding sleeve. Therefore, both characterize an electric or electro-hydraulic system.

The sliding sleeve is in charge of controlling the area available for the flow of produced/injected fluid towards the interior/exterior of the production/injection string.

The tool which is the object of the present invention comprises a fully electric tool (FIG. 3), operating by the rotation of independent shafts with piles of spheres, so as to totally or partially coincide the said spheres windows with the spheres bores, making the radial communication between the external and internal media (respectively well annular and production string). The tool is therefore directed to the flow control in production/injection wells by means of the variation of the communication area of the said spheres' windows to the spheres' bores.

In spite of the availability of several tools in the oil and gas industry (including completion systems) which utilize the principle of spheres to perform the opening and closure of flow passages, none of these presently-known tools is based on the concept of the operation of piled spheres on a same shaft, obtaining a single element such as described and claimed in the present invention. Further, the effect on the flow control obtained by the use of the series of piled spheres was not predictable on the basis of the state-of-the-art technique in view of the different configurations of spheres according to the invention. the said several configurations are obtainable both from the number of windows of each sphere and their relative position.

Such configurations are a further point which allows distinguishing the present invention from the state-of-the-art technique. At the same time, the tool of the invention innovates by utilizing the concept of piled spheres to reach continuous downhole flow. Furthermore, the tool of the invention operates the set described above in the present specification in a fully electric manner by means of a single supply cable.

There are numerous downhole tools based on the concept of spheres for the operations of opening, closure or control or flow direction, these tools being characterized as valves.

Thus, in Published International Application WO2016099485A1 a tool is described for selectively isolating the flow through a production packer or other subsea device. The tool and method make use of a ball valve, which moves from an open position to a closed position by lateral or axial movement of the production tubing as opposed to the production rotation, being differentiated both in the application concept, the operation system and on the physical concept of the present tool.

U.S. Published Patent Application 20140160891A1 relates to a production tubing combination pressure reducing and signaling valve assembly utilizing multiple ball valves mounted in parallel. Each valve is provided with a different bore for fluid flow through the production tubing. The individual ball valves are kept either in the completely open position or in the completely closed position. The size of the individual ball valves bores are such that for a certain pressure a first ball valve has a pre-determined flowrate, a second ball valve has double the flow rate of the first ball valve, a third ball valve has double the flowrate of the second ball valve and the remaining valves have each double the flowrate of its predecessor in the valve sequence. In this way it is possible to control the flowrate and pressure reduction by varying the combination of open and closed valves. This technique differs from the invention by the concept of application, the operation system and in the physical concept of the tool object of the invention.

Published International Application WO2016099485A1 and U.S. Published Patent Application 20140160891A1 are characterized by the concept of individual spheres (or ball valves as they are named in the patent document US20140160891A1) positioned inside the production string so as to constitute an isolation system between one zone and the other (inside the production string), and differing both in the application concept, in the operation system or in the physical concept of the tool which is the object of the invention.

U.S. Published Patent Application 20140224342A1 relates to a flow control valve which operates by successive opening of different flow routes, starting with a route requiring reduced force to operate its entry valve. Flowrate through the control valve is controlled by the opening and closure of different flow rates in individual or combined way. Such routes are of cylindrical geometry, and are varied according to the axial movement generated by means of the upper mechanical element. In this way it differentiates from the tool of the invention, by the form and direction of operation, and by the lack of utilization of spheres as communicating elements for opening.

U.S. Pat. No. 5,832,996 relates to an electro-hydraulic valve which employs a solenoid valve encapsulated in the interior of the downhole tool, which upon receiving hydraulic power either from the surface or from the wellhead directs the hydraulic line to the opening or closure chamber of the device in agreement with the desired operation. Still, such a technique depends on hydraulic power for operating, which does not completely eliminate the hydraulic lines from the system, with the ensuing requirement of a HPU.

U.S. Pat. No. 6,253,843 refers to a downhole safety valve with electric operation, wherein an electric motor is coupled to a spindle by means of one of more couples of reduction gears. The spindle, when operated by the motor, moves an endless screw which is attached to the outer portion of a sleeve. The sleeve advancement pushes the sealing window of the string surpassing the spring resistance which keeps the window closed. When the sleeve is retreated, the spring force closes the window so as to interrupt string production.

In this way, in spite of the technique having a few tools, either for the flow control in production and/or injection wells, or the use of the concept of spheres for flow opening, closure, control and direction, none of the retrieved documents, considered on their own or in any way of combination anticipate the concept of the tool object of the present invention,

SUMMARY OF THE INVENTION

Broadly, the present invention comprises a fully electric tool connected to a production string (105), such tool being designed for the oil and gas flow control, the control being obtained by the precise variation of the opening or closure of windows (125) contained in shaft(s) (108) of piles of spheres (124*a*,124*b*,124*c*), said shaft(s) (108) being positioned diametrically to the axle of said production string (105).

The selective control of the opening and closure position of said windows (125) is obtained by the rotation on their shaft (108) of the said piles of spheres (124*a*,124*b*,124*c*).

The fully electric tool (100) of the invention for continuous downhole flow control comprises:

a) a body (101) conceptually cylindrical, the upper and lower ends of same being connected to the said production string (105) by means of threaded connections (107*a*, 107*b*) respectively, said body (101) comprising an outer wall called "cover" (112), said body (101) being provided with at least one bore (111), said bores (111) being each provided with a seal seat (109) and an opposition basis (110), said bores (111) being designed to allow the passage of fluid between the production string (105) and the well annular (136), said cylindrical body (101) including further ultrasonic oscillators;

b) along the body (101) of a), actuating set(s), each actuating set comprising:

b1) a passage system (102) formed by shaft(s) (108) parallel to the axis of production string (105), said shaft(s) (108) being radially disposed along said cylindrical body (101), each of said shaft (108) operating with its opposed pair or independently in a well-defined position or not, said shaft(s)(108) comprising spherical elements (124) provided with at least one window (125), forming piles of said spherical elements (124) in direct and constant contact with the said seal seats (109), the rotation of said shaft(s) (108) of piles of spheres (124) enabling the total or partial opening or closure of said bores (111) by the total or partial coincidence of said window(s) (125) of said spheres (124) with said bores (111) of said cylindrical body (101), in a continuous control of opening or closing of said window(s) (125); and b2) In order to operate the passage system (102), a driving system (103) formed by an electro mechanical device selected among a motor (117) to generate the rotation movement of said shaft (108) of piles of spheres (124) and wherein each passage system (102) of b) relies on a driving system (103) of its own to secure independent rotation of same relative to any other shaft (108), in this way characterizing the independence of each of said actuating sets, and wherein said motor (117), encapsulated by a housing (120) copes structurally with differential pressures above 1,400.00 kgf/cm$^2$ at temperatures around 200° C.;

c) an electronic module (104) in charge of i) taking an electrical supply cable (122) and splitting same into a first portion and a second portion, the first (multiplexed) portion designed to the supplying of motors (117) and sensors, the second portion being designed to the continuation of the supplying line and sensing of the remaining production line of the tubing string (105); including temperature and pressure, position, vibration sensors and accelerometers without being limited to those, so as to secure the monitoring and diagnosis of the well and of the tool (100) during production/injection operation, both for the well production string (105) and annular (136); iii) containing differential pressure sensors applied to the determination of flow rate and iv) keeping control of the signal transmission of said motors (117) from the surface as well as of the signal transmission of said sensors to the surface, and wherein i) the contact among said seal seats (109) and said window(s) (125) of said sphere(s) (124) makes or destroys physical communication between said production string (105) and the well annular (136) to allow or block the flow of fluid; and ahead-end travel limit (126) located at the shaft (108) of the sphere(s) (124) enables the positioning control of said window(s) (125) in the mechanical mode, from which it is possible to measure the rotation of said shaft(s) (108).

DETAILED DESCRIPTION OF THE PREFERRED MODE

Figure 1:
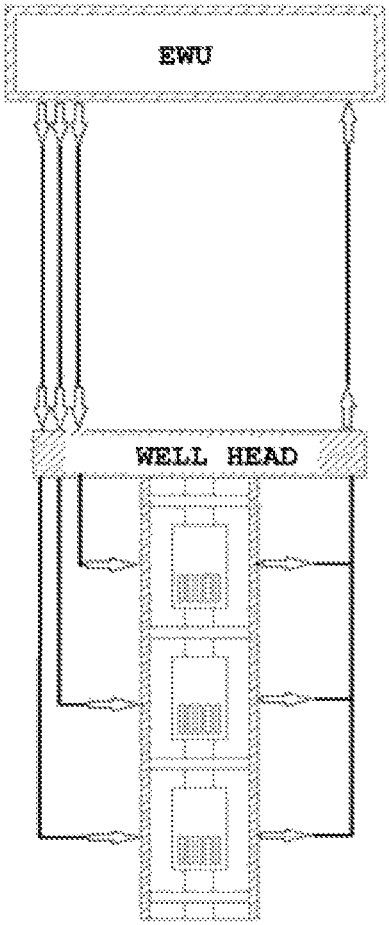
FIG. 1 attached is an illustration of the conventional hydraulic operation system for the flow control of a three-zone oil well.
Figure 2:
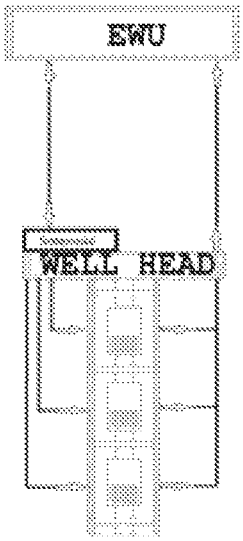
FIG. 2 attached is an illustration of the conventional electro hydraulic operation system for the flow control of a three-zone oil well.
Figure 3:
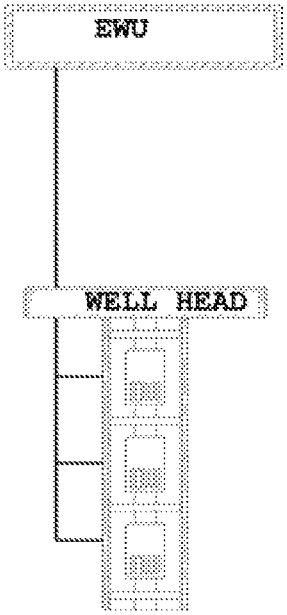
FIG. 3 attached is an illustration of a fully electric operation system for the tool of the present invention in a three zone oil well.
Figure 4:
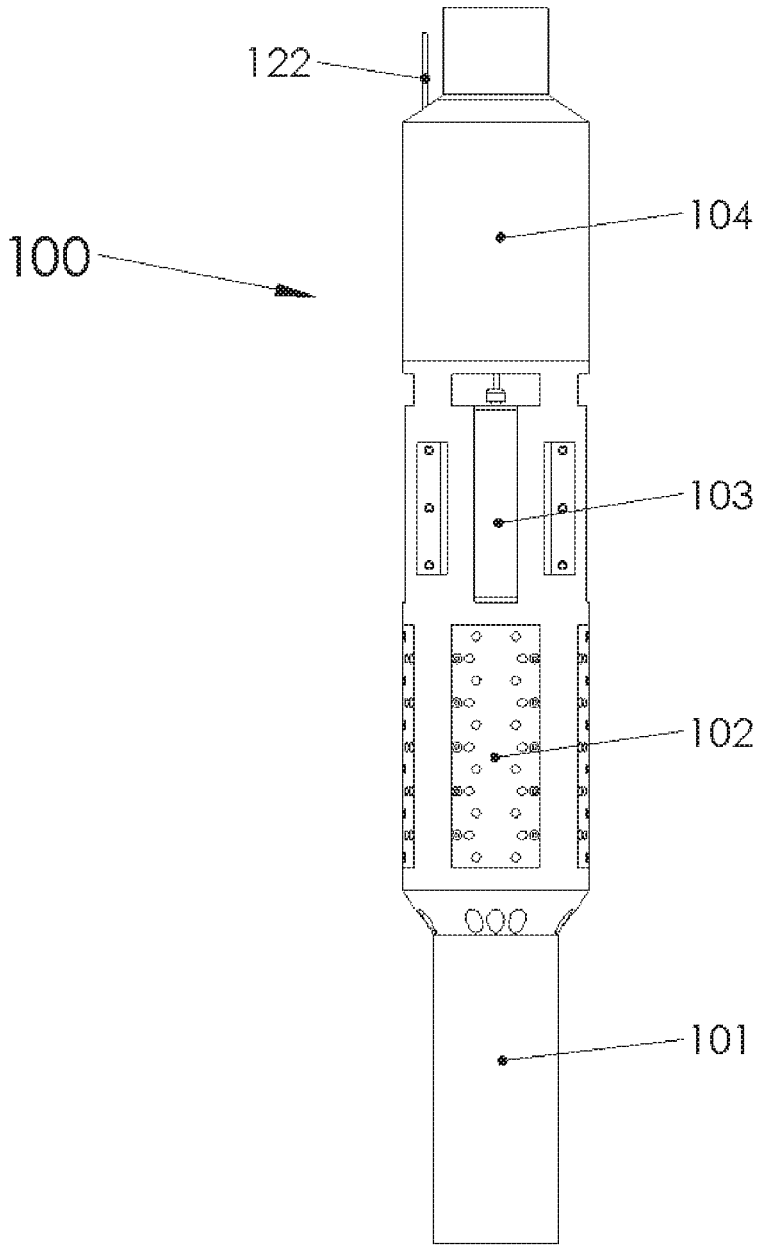
FIG. 4 attached is a full front view of the valve which is the object of the invention FIG. 5 attached is a full view, in front section, of the valve which is the object of the invention FIG. 6 attached is a detailed view of the front section of the driving system of the valve which is the object of the invention.
Figure 5:
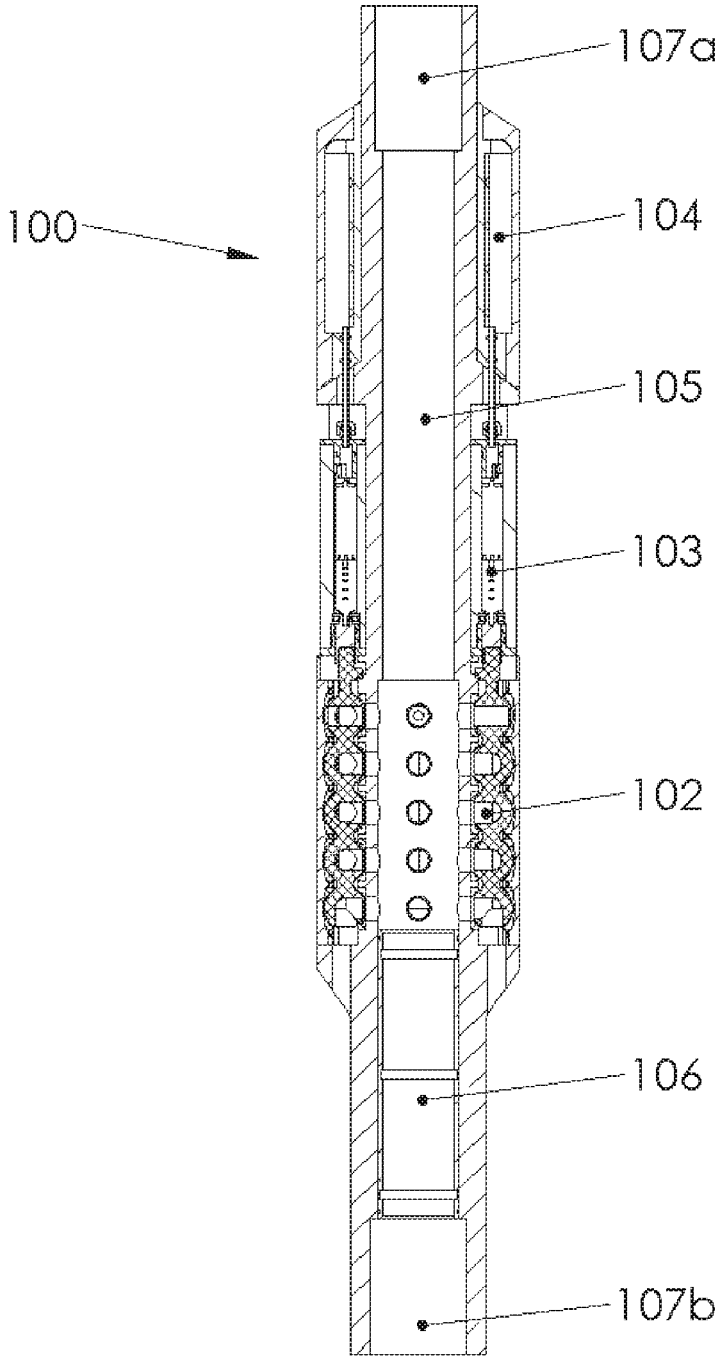

The invention relates to a tool, generally designed by numeral (100), of fully electrical operation and with accurate variation in the opening and closure of window(s) (125) located diametrically to the production string (105) axle. The selective control of the opening and closure position of said window(s) (125) is achieved by rotation shaft(s) (108) of pile(s) of sphere(s) (124) provided with said window(s) (125).

According to the invention, the expression "window" (125) means holes of the body of spheres (124), said holes aiming at the flow of fluid between the production string (105) and the well annular (136). Still according to the invention, in a sphere (124) provided with at least two windows (125), said windows are convergent, that is, they form a hole within the said sphere (124). On the other side, for a sphere (124) provided with only one window (125) said window (125) does not converge with any other of said windows (125), the passage of flow between production string (105) and well annular (136) being achieved by said window (125) geometry.

According to the invention, the expression "shaft" (108) of pile(s) of sphere(s) (124) means the element to which are attached the said sphere(s) (124), said element being in charge of transmitting the rotation movement for opening or closing said window(s) (125).

According to the invention, from now on in the present specification the notation (124*a*,124*b*,125*c*) means a specific model or configuration of sphere (124).

According to the invention, the expression "sphere" (124) means the portion of the shaft (108) having a spherical geometry through which is achieved the sealing of the window(s) (125). To each sphere(s) (124) correspond at least one window (125).

According to the invention, the expression "motor" (117) means the electrical mechanical commercial component in charge of the torque generating the rotation movement of said shaft (108) of pile(s) of sphere(s) (124).

To the knowledge of the Applicant, on the tool (100) object of the invention is applied an innovative architecture as compared to state-of-the-art tools. The flow control which is conventionally obtained by the sliding sleeve in the present tool (100) is obtained by the concept of a shaft (108) of pile(s) of sphere(s) (124) where said sphere(s) (124) are provided with at least one window (125). Sphere(s) (124) are piled on at least one shaft (108) located on the production string (105) wall.

According to one mode of the invention one single shaft (108) is considered on the production string (105) wall. According to another mode, an uneven number (≥3) of axes (108) of piles of spheres) (124) is considered.

In a further mode of the invention an even pair of shafts (108) of piles of sphere(s) (124) is selected among two, four or higher, forming symmetrical pairs of axes (108).

Each shaft (108) relies on a motor (117) suitable to secure i) independent rotation or ii) rotation among said shaft(s) (108). In this way it is possible to control the fluid passage through each shaft (108) of piles of sphere(s) (124) in an independent way.

For each of the modes described above in the present specification, a single actuating set b) is provided, said set operating in an independent way. Further, in an additional mode of the invention an uneven number (≥3) of actuating sets is provided, operating either in independent way or combined way.

In another mode of the invention an even number of actuators b), selected among, two, four, six or more, forming symmetrical pairs along said body (101) of tool (100).

The invention will be described below by reference to the attached Figures, which should not be construed as limiting of same.

The tool (100) of the invention comprises a conceptually cylindrically body or base (101) provided with ultrasonic oscillators (not represented) and bores (111) which enable the passage of fluid between the production string (105) and the well annular (136).

Figure 7:
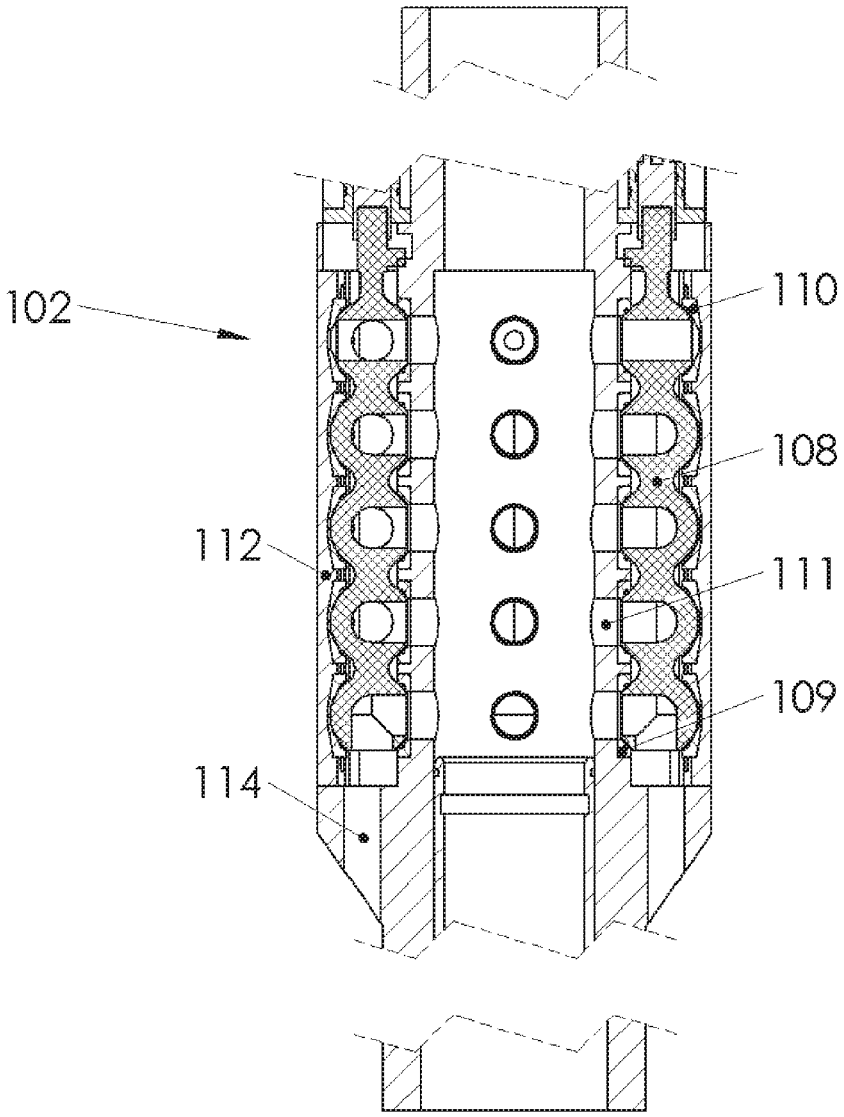
FIG. 7 attached is a detailed view of the front section of the passage system of the valve which is the object of the invention.

Each and every bore (111) is provided with a seal seat (109). The spheres (124) mentioned above in the present specification are in direct and constant contact with the said seal seats (109). (See FIG. 7).

The total or partial opening or closure (blockage) of said bores (111) is obtained by the rotation of said shaft(s) (108) of pile(s) of sphere(s) (124). Such movement enables the total or partial coincidence of the window(s) (125) of the sphere(s) (124) with the bores (111). In this way a physical communication is established between the production string (105) and the well annular (136), said communication entailing the passage of fluid (see FIG. 7).

According to the preferred mode, the tool (100) of the invention comprises four actuating sets contained in body (101) of the said tool, said actuating sets being disposed in two symmetrical pairs along said body (101) of tool (100). Each actuating set is made up of driving system (103) and a passage system (102). The driving system (103) operates the passage system (102) and is made up chiefly of a motor (117). The passage system (102) is mainly made up of the shaft (108) of pile(s) of sphere(s) (124) (see FIG. 9), said sphere(s) (124) being selected among one of the models or configurations (124*a*,124*b*,124*c*) mentioned above in the present specification. In the said preferred mode said shaft (108) of pile(s) of sphere(s) (124) envisage five spheres (124) with three different configurations (124*a*,124*b*,124*c*).

Being in charge of the rotation movement of the shaft(s) (108) of pile(s) of sphere(s) (124), motor(s) (117) is (are) conditioned within a housing (120) which meets structurally pressure differentials higher than 1,400.00 kgf/cm$^2$ at elevated temperatures, around 200° C.

Figure 6:
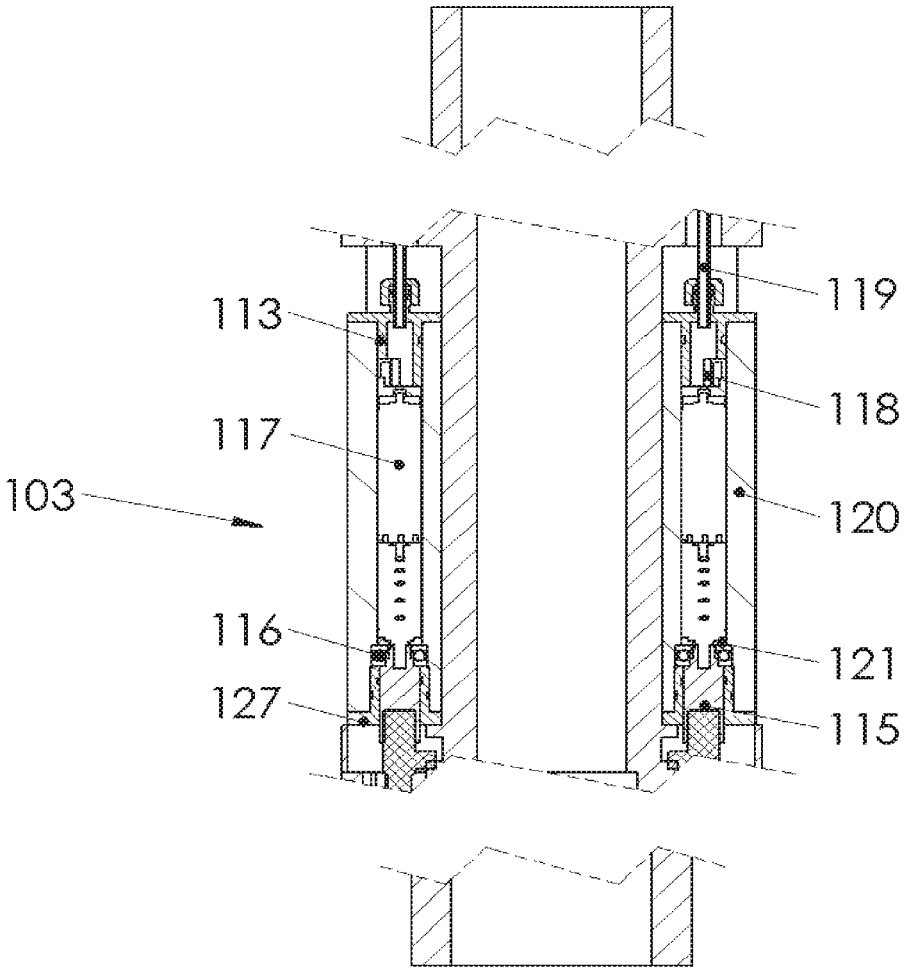

Housing (120) is provided with a sealing system (113) obtained by angular interference between two parts, said system being considered as a high dependability main barrier. Inside said housing (120), besides motor (117), there are also sealing seals (113) as secondary barriers, lock (118) which positions and attaches motor (117) to hinder the rotation of same beyond the recommended level, axial bearings (116) supported on bushings (121) to withstand the charges operating at interface (115), said charges being generated by the pressure differential. Said interface (115) is designed for transmitting movement between motor (117) and said shaft(s) (108) of pile(s) of sphere(s) (124), both motor (117) and interface (115) being supported and backed by a frontal cap (127). (see FIG. 6).

The positioning of motor (117) in said driving system (103) is based on the presence of a head-end travel limit (126) positioned in the shafts (108). Head-end travel limit (126) determines a reference initial point of motor (117) by mechanical contact, and from there on the rotation of shaft(s) (108) of pile(s) of sphere(s) (124) occurs, controlling the position of said sphere(s) (124) and consequently the position of window(s) (125).

The mode of the invention making use of ahead-end travel limit (126) forshaft(s) (108) of pile(s) of sphere(s) (124) meets accurately all positioning control requirements and provides mechanical safety to driving system (103).

Communication between electronic module (104) and driving system (103) is performed by a cable (119) which enables the power supply of motor (117).

Motion of motor (117) axle is enabled by a simple system of bushing (121) and axial bearing (116). The movement transmission of motor (117) towards the shaft(s) (108) of pile(s) of sphere(s) (124) is obtained by an interface (115) coupled to a drive shaft (123).

Passage system (102) is provided, on the lower portion of cylindrical body (101), of a drain channel (114) serving as main entrance for the flow of fluid which feeds the shaft(s) (108) of pile(s) of sphere(s) (124).

Passage system (102) (region through which the fluid flows) is manufactured from a high hardness noble alloy. For the treatment of the shaft(s) (108) of pile(s) of sphere(s) (124) should be considered besides thermal physical and thermal chemical treatments, coating with Tungsten carbide (such as Hardide), Tungsten Carbides in Ni—Cr—B matrix (Conforma Clad, Amstar 88), Hexoloy (Silicon Carbide), ALNimax (Aluminum Nitride) orMoralide (Silicon Nitride), among other ones which are useful for the purposes of the invention. These procedures aim at the improvement of erosion resistance and scale formation, which constitute critical issues as relates to downhole valves.

As relates to spheres (124), useful for the invention are the metallic spheres with features of performance and sealing similar to those employed in the globe valves conventionally used in the industry, including the oil industry.

According to the invention, for each of the four shafts (108) of pile(s) of sphere(s) (124), in the preferred mode but not the only one nor the mandatory one, are encompassed five spheres (124*a*,124*b*,124*c*), this notation referring to three different configurations according to the number of passages allowed between production string (105) and annular (136).

Figure 8:
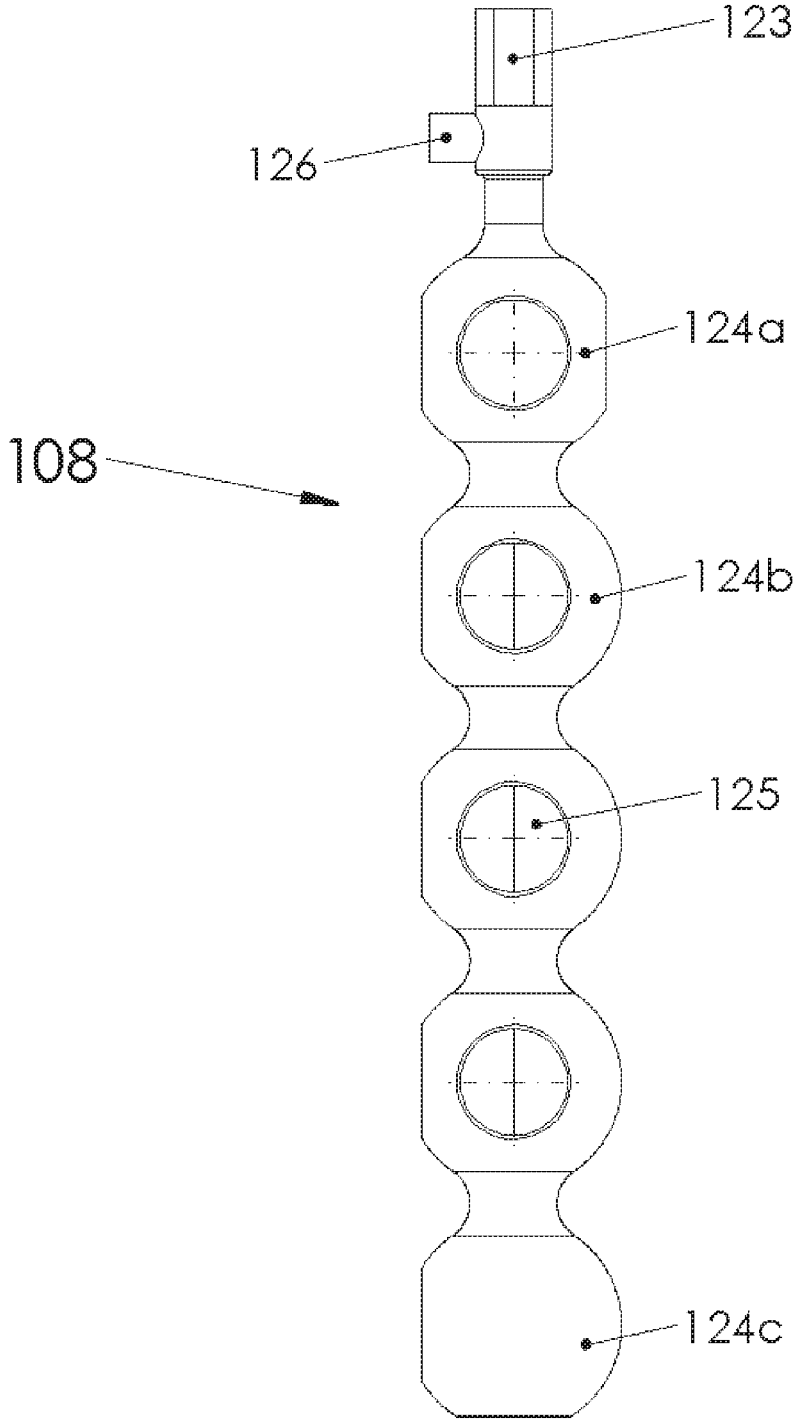
FIG. 8 attached is a front view of the piles of spheres of the preferred mode with five spheres.
Figure 9:
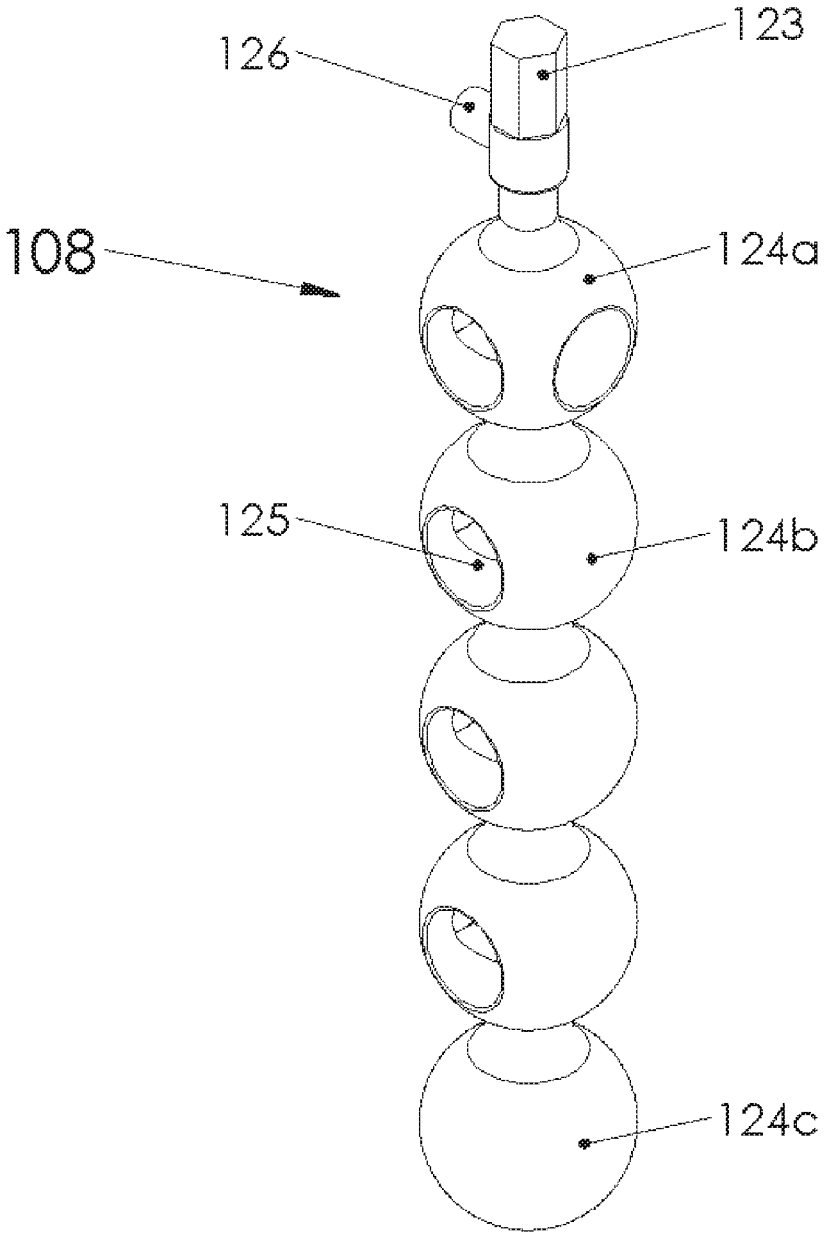
FIG. 9 attached is an isometric view of the piles of spheres of the preferred mode with five spheres.

It should be clear for the experts that the number of five spheres (124*a*, 124*b*, 124*c*) is a natural, non-mandatory standard, of the invention, as well as the geometry of such windows (125) (see FIGS. 8 and 9).

According to the preferred mode of the invention, the arrangement of positions of the kind of spheres (124) which make up shafts (108) of pile(s) of sphere(s) (124) characterizes three opening positions and one obstruction or closure position of the passage between production string (105) and well annular (136), all the positions being well-defined positions.

According to one mode of the invention, depicted in FIGS. 8 and 9, following a descending order, the first sphere (124*a*) admits the first sphere model and is provided with three convergent windows (125), therefore it bears three well-defined opening positions and one obstruction position Second, third and fourth spheres (124*b*) constitute the second sphere model and comprise two convergent windows (125) having the same relative position. Therefore, they have two well-defined opening positions and two other obstruction positions.

The fifth and last sphere (124*c*) constitutes the third sphere model and also has two convergent windows (125). The first of said windows (125) is in communication with production string (105) while the said second window (125), located in the lower portion of sphere (124*c*), allows the passage of fluid when this model takes the opening position. The sphere model (124*c*) has one opening position and three obstruction positions, all positions being well-defined positions.

In the preferred mode of the invention all the windows (125) have the same geometry and dimensioning.

In another mode, the size of windows (125) is non-uniform, resulting in customized percentages of opening and closure of the passages between the production string (105) and annular (136).

The three opening positions and one obstruction position, characterized by the preferred arrangement of the said spheres models (124*a*,124*b*, 124*c*) constitute the said "defined positions" as used in the present invention. Defined positions are reached by rotation of shaft(s) (108) of pile(s) of sphere(s) (124*a*,124*b*,124*c*) every 90° C. The control of the fluid passage is enabled by the control of the positioning of shaft(s) (108) at the defined positions and among them. This is because the positioning control of said shaft(s) (108) relates to the control of the amount of opening and closure of windows (125).

As mentioned above in the present specification, in said preferred mode, the tool (100) encompasses four shafts (108) of piles of spheres (124), wherein each shaft (108) of piles of spheres (124) is provided with five spheres (124*a*, 124*b*,124*c*).

In this way each sphere (124) with its respective windows (125) represents 5% of the total opening surface area. Each shaft (108) of pile of spheres (124*a*,124*b*,124*c*) of said preferred mode has four well-defined positions, and each well-defined position corresponds respectively to 0% (all spheres in the position of total obstruction), 5% (only sphere (124*a*) in the opening position) 20% (sphere (124*a*) and spheres (124*b*) in the opening position) and 25% (all spheres (124) in the opening position) of the total opening surface area.

In cases of high pressure differential between production string (105) and annular (136) and a high number of particles and debris in suspension in the drained fluid, according to the preferred mode each shaft (108) of pile of spheres (124) is operated with its opposed pair in the same well-defined position. This procedure is intended to annihilate opposed flow so that they do not affect production string (105) wall by erosion. Thus, it is possible to state that each pair of opposed shafts (108) of pile of sphere(s) (124), at each well-defined position represents 0%, 10%, 40% and 50% of the total opening surface area.

The preferred mode of the invention contemplates the combination of well-defined positions between two pairs of shafts (108) of pile of sphere(s) (124) so as to attain in discreet form 0%, 10%, 20%, 40%, 50%, 60%, 80%, 90% and 100% of the total opening surface area. Such mode of operation does not require a complex control and demonstrates the way enabling to reach, in discreet form, several percentages of total window(s) (125) opening area by the combination of well-defined positions of said shafts (108) of pile of sphere(s) (124).

On the other hand, it should be clear for the experts that according with the invention, such procedure does not limit in any way the use of the invention for the continuous control of the positioning of shafts (108) of pile of sphere(s) (124), since the well-defined positions are not limiting of the positions that the tool (100) may exhibit. Tool (100) controls further the continuous positioning between the well-defined positions, which allows obtaining any percentage of total opening surface area.

It is well-known that the ratio between total opening surface area and the flow of fluid is not linear and that such ratio depends directly and indirectly of the characteristics of each well. In this way it is possible that the use of the discreet and simple control of tool (100) be sufficient for the flow control of a wide range of wells. Even so, it is also possible to make use of the continuous control of tool (100) for wells of more complex characteristics.

According to the scope of the invention, modifications aiming to the optimization of the control related to each well peculiarities and respective ways of operation are considered. Thus, to cope with such needs, alternatively tool (100) of the invention comprises a higher or lower number of actuating sets (wherein one mode of the invention includes a single of said actuating sets), as well as varied amounts of spheres (124) and/or window(s) (125), of different geometries and dimensions.

As explained hereinbefore, a further distinguishing point of the invention is the possibility of employing shafts (108) of pile of sphere(s)(124) having varied number of spheres (124*a*,124*b*,124*c*), other than the standard number of said spheres.

Figure 10:
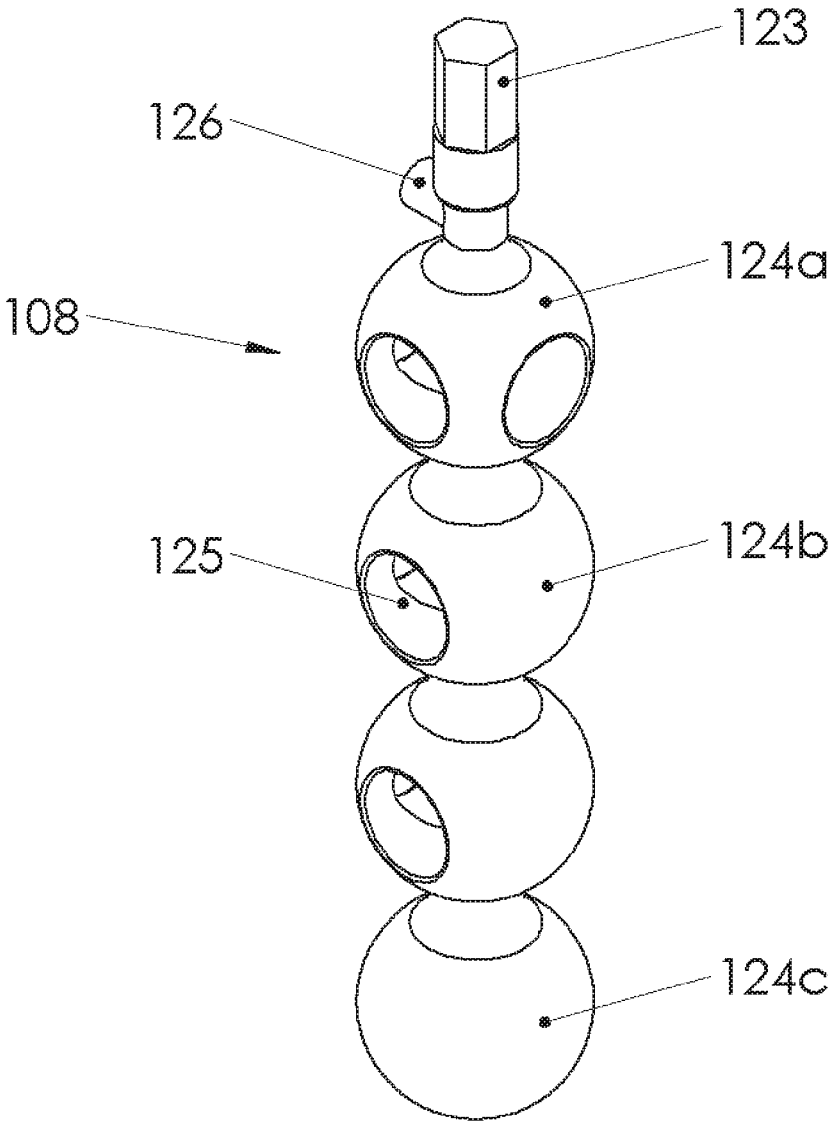
FIG. 10 attached is an isometric view of the piles of spheres with four spheres.

Thus, for shafts (108) of pile of sphere(s)(124) having four spheres (124) (see FIG. 10) with four actuating sets, it is made use of three kinds of spheres (124*a*,124*b*,124*c*) as is the case of the shafts (108) of pile of sphere(s)(124) of five spheres (taken as standard configuration). In this way each of the well-defined positions of the shaft(s) (108) of four spheres (124*a*,124*b*,124*c*) represents respectively 0%, 6.25%, 12.5% and 25% of total opening surface area, by shaft (108) of piles of spheres (124).

Figure 11:
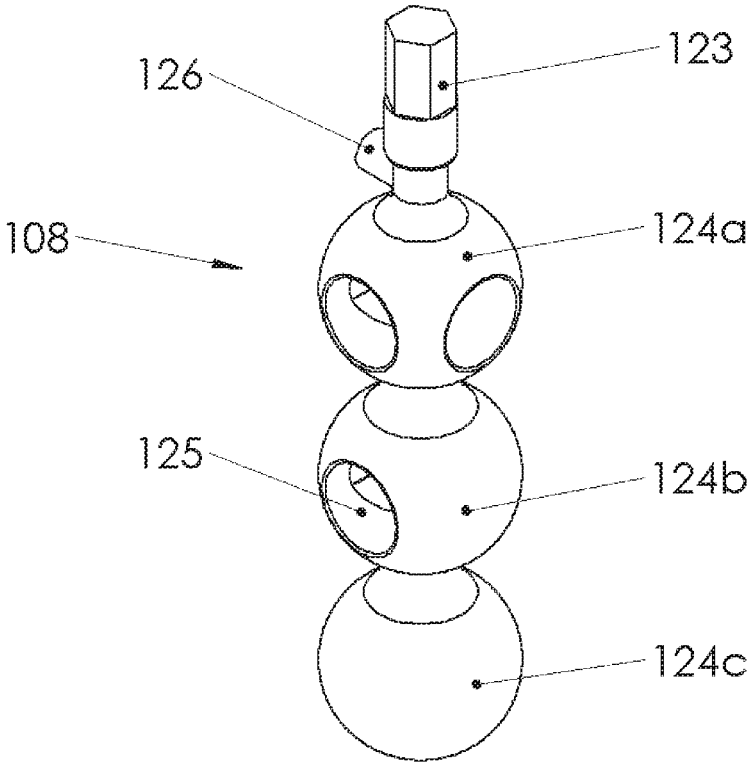
FIG. 11 attached is an isometric view of the piles of spheres with three spheres.

According to the mode of the invention comprising shafts (108) of piles of spheres (124) having three spheres (124*a*, 124*b*,124*c*) with four actuating sets, use is made of three kinds of spheres (124), one sphere (124*a*), one sphere (124*b*), and one sphere (124*c*), (see FIG. 11). In this way for each standard position are reached respectively 0%, 8.33%, 16.66% and 25% of the total opening surface area by shaft (108) of piles of spheres (124).

Figure 12:
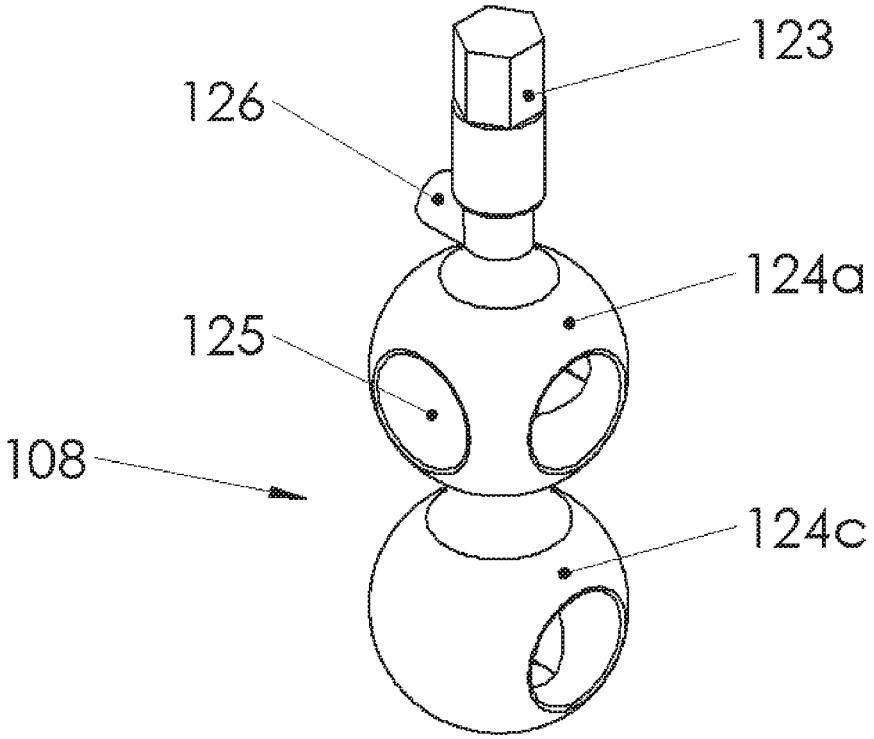
FIG. 12 attached is an isometric view of the piles of spheres with two spheres.

In the mode of the invention comprising shafts (108) of piles of spheres (124) having two spheres with four actuating sets, two kinds of spheres are employed, (124*a*,124*c*) (see FIG. 12), In this way, it is possible to reach 0%, 12.5%, and 25% of the total opening surface area by shaft (108) of piles of spheres (124).

Figure 13:
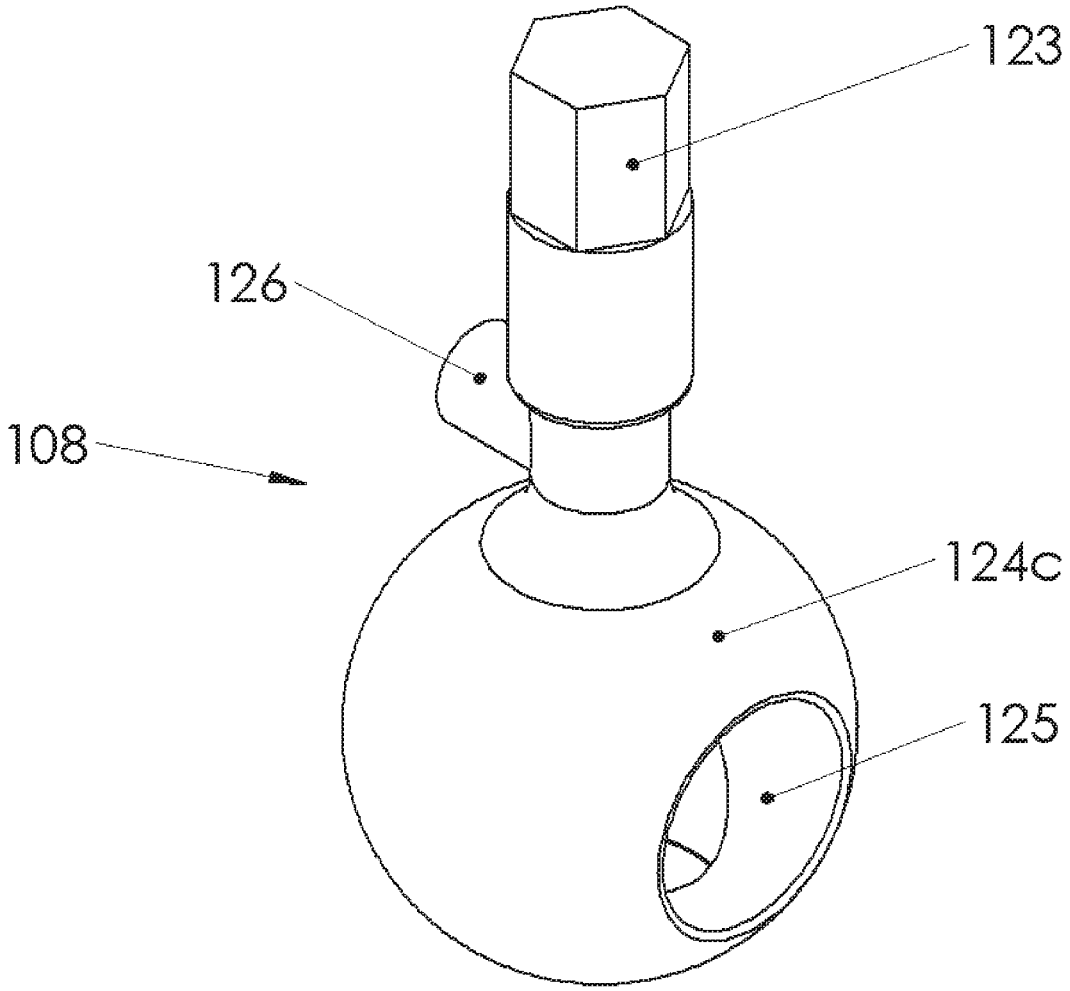
FIG. 13 attached is an isometric view of the piles of spheres with one sphere.
Figure 14:
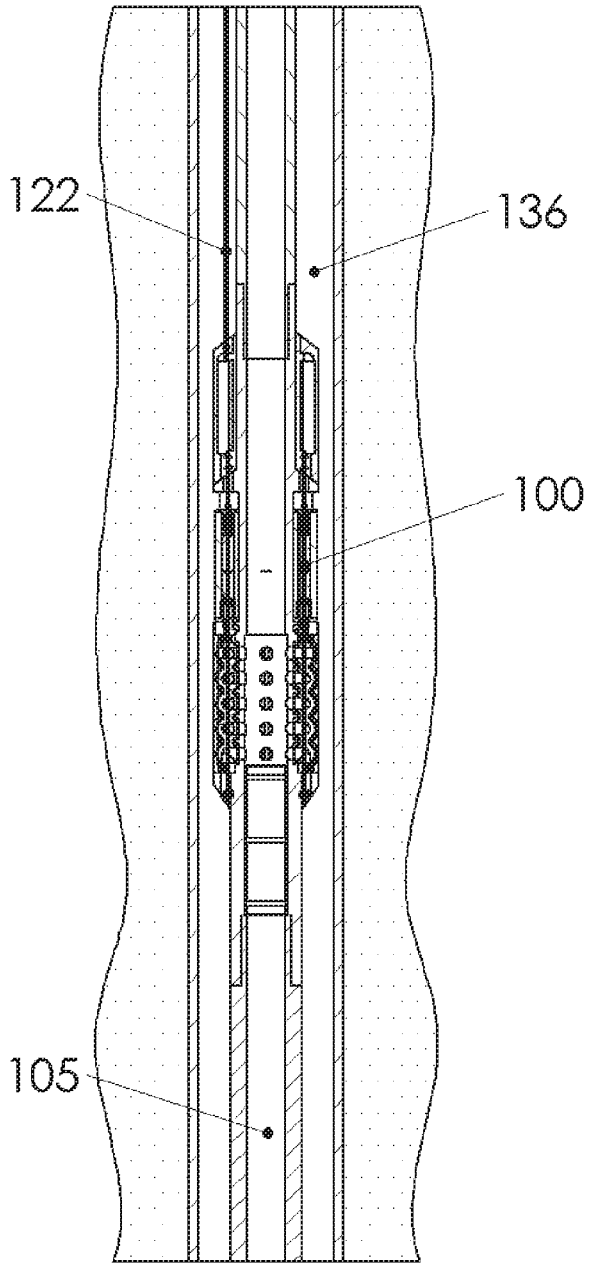
FIG. 14 attached is a section view of the tool which the object of the invention in the interior of the well.

Further, the invention considers one mode of the invention comprising shaft(s) (108) of piles of spheres (124) having one sphere. In this mode, with four actuating sets, it is made use of one single kind of sphere (124*c*)(see FIG. 13), In this way, it is possible to reach 0% and 25% of the total opening surface area by shaft (108) of piles of spheres (124).

It should be borne in mind that this model of sphere is not exclusive, it has been selected as an example only, since it is the only model having one well-defined closure position and three well-defined opening positions. Nonetheless, other model(s) of sphere(s) (124) or window(s) (125) are equally useful for the purposes of the invention, provided the same percentage of total opening surface area by shaft (108) of piles of spheres (124) is achieved.

A further mode considers a number of spheres (124) of shaft (108) of piles of spheres higher than five spheres (124).

Additionally, the invention encompasses a mode comprising shaft(s) (108) of piles of spheres (124) of said spheres having one single window (125) lacking convergence, but endowed with a geometry such as to allow the passage of flow between production string (105) and well annular (136).

Still, tool (100) of the invention, for the purposes of redundancy (safety) and compliance with the regulations in force, is additionally manually operated for opening and closure by means of a device such as a sliding sleeve (106), aiming at securing the sealing redundancy of tool (100) when in the closed position.

It is possible to make use of sliding sleeve (106) as a safety system in case of impairment of the driving system (103), the operation by means of a wire (conventional operation making use of a shifting tool) descending through production string (105) anchoring on the sleeve and moving same according to the direction desired by the operator.

Tool (100) according to the invention contemplates pressure, temperature, vibration and position sensors, accelerometers and pressure differential meters (not represented) without being limited to those. Such equipment is designed for production monitoring, by monitoring being understood the acquisition of pressure, temperature and other variables data, on production string (105) as well as on the well annular (136).

Disposed throughout (101) the whole body of the tool (100) are ultrasonic oscillators (not represented). Whenever actuated, these oscillators provide intermittent oscillations, triggering mechanical vibrations which propagate throughout body (101) of tool (100). Such vibrations result in the mechanical or thermal removal of undesirable scales and deposits on body (101) of tool (100).

Tool (100) is provided with an electric module (104) aiming at securing communication since surface up to said tool (100). For this purpose said module (104) should include the necessary electronics (transmission plates, data acquisition, etc) for performing control signal transmission from the surface of motors (117) of tool (100) and the transmission of sensors signals to the surface.

Electric supply of the actuation is obtained by means of one single electric cable. The same cable is in charge both of the electric supply and of communication of all of the electric components of production string (105). Said cable (122) of electric supply and communication is split into two lines, a first line is designed for supply continuity and communication of the production string (105) while the second line is multiplexed and used both for motors (117) electric supply and sensors reading (not represented).

The mode of operation of tool (100) confers to it advantageous features which distinguish same from available, conventional state-of-the-art tools. Among said advantages, the lack of need of constant electric supply for keeping the positioning of shafts (108) of piles of spheres (124). The rotation of the shafts (108) of piles of spheres (124) demands low angular displacement by motor (117) to attain any opening surface. This feature favors low energy consumption by motors (117) which should make efforts to surmount the friction of seals (109) of spheres (124). Also favored is the response period of tool (100) for reaching the desired flow. If the actuation of shafts (108) of piles of spheres (124) in pairs is not considered, it is possible to increase the range of opening surfaces attained by the tool (100) of the invention.

The invention claimed is:

1. A fully electric tool for the continuous downhole control of fluid flow between a production string having access and a well annular, said tool comprising:

a) a cylindrical body, with superior and inferior ends of same being connected to the production string by means of threaded connections respectively, said body comprising an outer wall or cover, said body being provided with at least one bore provided with a seal seat and an opposition base, each bore being designed to allow the passage of fluid between the production string and the well annular;

b) along the cylindrical body, at least one actuating set, each actuating set comprising:

b1) a passage system formed by at least one shaft parallel to the axis of the production string, said at least one shaft being radially disposed along said cylindrical body, said at least one shaft comprising spherical elements provided of at least one window, forming piles of spherical elements in direct and constant contact with the said at least one seal seat, the rotation of said at least one shaft of piles of spheres enabling the total or partial opening or closure of said bores by the total or partial coincidence of said at least one window of said spheres with said bores of said cylindrical body, in a continuous control of opening or closing of said at least one window; and b2) in order to operate the passage system, a driving system formed by an electro mechanical motor to generate the rotation movement of said shaft of piles of spheres and wherein each passage system of b1) relies on a driving system of its own to secure independent rotation of its shaft, in this way characterizing the independence of each of said actuating set, and wherein said motor, encapsulated by a housing copes structurally with differential pressures at 1,400.00 kgf/cm$^2$ at a temperature of 200° C.;

c) an electronic module in charge of i) taking an electrical supply cable and splitting same in a first and a second portion, a first portion configured to supply motors and sensors, the second portion being designed for a supplying line and sensing of a remaining production line; and wherein i) the contact among said at least one seal seat and said at least one window of said spheres makes or destroys a physical communication between said production string and the well annular to allow or block the flow of fluid; and ii) a head-end travel limit located at the shaft of the spheres enables the positioning control of said window(s) in the mechanical mode, from which it is possible to measure the twist of said shaft.

2. The tool according to claim 1, wherein said tool comprises one single actuating set b) operating in an independent way.

3. The tool according to claim 1, wherein said tool comprises an even number of actuating sets b), selected among two, four, six or more actuating sets, forming symmetrical pairs along said body of the tool.

4. The tool according to claim 1, wherein said tool comprises an uneven (≥3) number of actuating sets b), operating in an independent way.

5. The tool according to claim 1, wherein said tool comprises at least one shaft of piles of spheres operating in an independent way.

6. The tool according to claim 5, wherein said tool comprises an uneven (≥3) number of shafts of piles of spheres.

7. The tool according to claim 1, wherein said tool comprises an even number of shafts of piles of spheres selected among two, four, six or higher, forming symmetric pairs of said shafts.

8. The tool according to claim 1, wherein said housing, provided with a sealing system, encapsulates said motor and comprises further seal seats and a lock that position and attach said motor and axial bearings to support charges generated by the pressure differential and an interface to perform movement transmission between said motor and said shafts of piles of spheres.

9. The tool according to claim 1, wherein a lower portion of said passage system is provided, in the body, of a draining channel, said channel serving as a main passage of the fluid which feeds at least one shaft of piles of spheres.

10. The tool according to claim 1, wherein said tool comprises five spheres and four shafts, each shaft comprising three different models of spheres according to a variation of the number of passages allowed between the production string and the well annular.

11. The tool according to claim 10, wherein according to a first model the arrangement of positions of the kinds of spheres comprises a first sphere provided of three convergent windows characterizing three opening positions and one obstruction position of the passage between the production string and the well annular.

12. The tool according to claim 10, wherein, according to a second model, a sphere is provided with two windows, convergent with the same relative position, so as to present two opening positions and two well-defined obstruction positions.

13. The tool according to claim 10, wherein, according to a third model, a sphere is provided with two convergent windows, a first window being in communication with the production string, the second window located at the lower portion of said sphere, allowing the passage of fluid when this model is positioned in the opening position.

14. The tool according to claim 13, wherein, in said third model, a sphere comprises one opening position and three well-defined obstruction positions.

15. The tool according to claim 10, wherein said five spheres, each sphere with at least one window represents 5% of a total opening surface area and each shaft of piles of spheres presents four well-defined positions, each well-defined position corresponding respectively to 0%, with all five spheres at the total obstruction position, 5%, just one sphere in the opening position, 20% four spheres in the opening position and 25% all five spheres in the opening position of the total opening surface area.

16. The tool according to claim 10, wherein each shaft of piles of spheres operates with an opposite pair at the same position so as to annihilate opposed flows.

17. The tool according to claim 10, wherein positions are combined between two pairs of shafts of piles of spheres in order to attain in discreet form 0%, 10%, 20%, 40%, 50%, 60%, 80%, 90% and 100% of a total opening surface area.

18. The tool according to claim 10, wherein the control of the positioning of the shafts of piles of spheres is performed continuously.

19. The tool according to claim 1, wherein the control of the positions is performed continuously.

20. The tool according to claim 1, wherein each of the shafts of piles of spheres comprise four spheres, with three kinds of spheres, each of the positions of each shaft representing respectively 0%, 6.25%, 12.5% and 25% of a total opening surface area by each shaft of piles of spheres.

21. The tool according to claim 1, wherein each of the shafts of piles of spheres comprise two spheres, representing 0%, 12.5% and 25% of a total opening surface area by each shaft of piles of spheres.

22. The tool according to claim 1, wherein each of the shafts of piles of spheres comprise one sphere, representing 0% and 25% of a total opening surface area by each shaft.

23. The tool according to claim 1, wherein each of the shafts of piles of spheres comprise a number of spheres higher than five.

24. The tool according to claim 1, wherein each of the shafts of piles of spheres comprise spheres provided with windows of non-uniform sizes.

25. The tool according to claim 1, wherein each of the shafts of piles of spheres comprise spheres provided with one single window lacking convergence and wherein its geometry is such as to allow the passage of flow between the production string and the well annular.

26. The tool according to claim 1, wherein said tool having an area suitable for attaching one or more ultrasonic oscillators in said cylindrical body to create intermittent oscillations and vibrations for the mechanical or thermal removal of scales and deposits on said cylindrical body.

* * * * *